US008739807B2

(12) United States Patent
Taylor et al.

(10) Patent No.: US 8,739,807 B2
(45) Date of Patent: Jun. 3, 2014

(54) PROTECTIVE GLIDE FOR MEDICAL WALKER LEGS

(71) Applicants: Kevin Darrell Taylor, Farr West, UT (US); Michael Phillip Taylor, Farr West, UT (US)

(72) Inventors: Kevin Darrell Taylor, Farr West, UT (US); Michael Phillip Taylor, Farr West, UT (US)

( * ) Notice: Subject to any disclaimer, the term of this patent is extended or adjusted under 35 U.S.C. 154(b) by 0 days.

(21) Appl. No.: 13/632,769

(22) Filed: Oct. 1, 2012

(65) Prior Publication Data

US 2014/0090678 A1 Apr. 3, 2014

(51) Int. Cl.
*A45B 9/04* (2006.01)

(52) U.S. Cl.
USPC ..... 135/77; 135/84

(58) Field of Classification Search
USPC ..... 135/77, 84, 86, 82
See application file for complete search history.

(56) References Cited

U.S. PATENT DOCUMENTS

| | | | | | |
|---|---|---|---|---|---|
| 4,440,186 | A * | 4/1984 | Lottner | ..... | 135/84 |
| 4,510,957 | A * | 4/1985 | Frank | ..... | 135/84 |
| 5,301,703 | A * | 4/1994 | Kahn | ..... | 135/77 |
| 6,883,530 | B2 * | 4/2005 | Kawakami | ..... | 135/84 |
| 7,610,926 | B2 * | 11/2009 | Adams | ..... | 135/71 |
| 7,637,274 | B1 * | 12/2009 | Dodson | ..... | 135/84 |
| 7,743,780 | B1 | 6/2010 | Eggans | | |
| 7,882,848 | B2 | 2/2011 | Diamond | | |
| 2005/0205122 | A1 | 9/2005 | Bly et al. | | |
| 2006/0219280 | A1 * | 10/2006 | Robinson et al. | ..... | 135/84 |
| 2006/0272691 | A1 * | 12/2006 | DeLesline | ..... | 135/67 |

* cited by examiner

*Primary Examiner* — David R Dunn
*Assistant Examiner* — Danielle Jackson

(57) ABSTRACT

A protective glide for medical walker legs is disclosed in the present invention. Said protective glide comprises a wear disk for smooth walker moment on surfaces and a shield to cover said wear disk to prevent users from stepping on said wear disk and to prevent dirt and debris from collecting on the unit. The wear disk comprises an attached core containing gripping flanges and o-ring to snugly fit into the medical walker tubing. The present invention attaches easily to standard-size tubing of medical walker legs, without the use of tools. The rounded shape of the wear disk allows it to easily maneuver over rough and uneven surface and in any direction.

6 Claims, 12 Drawing Sheets

PROTECTIVE GLIDE FOR MEDICAL WALKER LEGS

BACKGROUND OF THE INVENTION

1. Field of the Invention

The present invention relates to a medical mobility device. More particularly, the present invention relates to a protective glide for medical walker legs.

Medical walker users typically have limited mobility and/or functionality. Stock model medical walkers are sold with rubber tips on the back legs which do not glide easily over surfaces and hinder movement. These rubber tips also wear out and need replacement or sometimes the user installs cut tennis balls, but they too do not last nor glide easily along with tracking dirt indoors.

2. Description of Related Art

Some related prior inventions are disclosed as prior art herein. More specifically, by way of example, U.S. Pat. No. 7,743,780B1 to David Eggan discloses a walker glide, which is a spherical attachment for removable installation over the lower end of a walker leg. The glide is formed of a hollow, resilient ball and includes a plurality of leg attachment holes therethrough. Such invention is suitable for any type of ball, and tennis balls have been found to work well.

U.S. PreGrant Publication No. US 2005/0205122 A1 to Bly et al. discloses a glide cap for walker. The glide cap includes a holder, and a replacement ball supported on the leg by the holder. The ball may be rotatable relative to the holder about a plurality of axes, and the ball may be a sport ball, such as a tennis ball.

U.S. Pat. No. 7,882,848 B2 to Diamond discloses a walker glide having a hollow body with a substantially semi-spherical shape, a top opening and a removable bottom element that are arranged along a common axis. A sleeve is arranged in the hollow body so as to extend from the top opening toward the bottom element. A mounting element is attached to an upper side of the bottom element and is releasably attached to a lower end of the sleeve whereby the bottom element is replaceable.

SUMMARY OF THE INVENTION

In an exemplary embodiment of the present invention, there is disclosed a protective glide for medical walker legs. Said protective glide comprises a wear disk for smooth walker moment on surfaces and a shield to cover said wear disk to prevent users from stepping on said wear disk and to prevent dirt and debris from collecting on the unit. The wear disk comprises an attached core containing gripping flanges and o-ring to snugly fit into the medical walker tubing. The present invention attaches easily to standard-size tubing of medical walker legs, without the use of tools. The rounded shape of the wear disk allows it to easily maneuver over rough and uneven surface and in any direction.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

Figure 1:
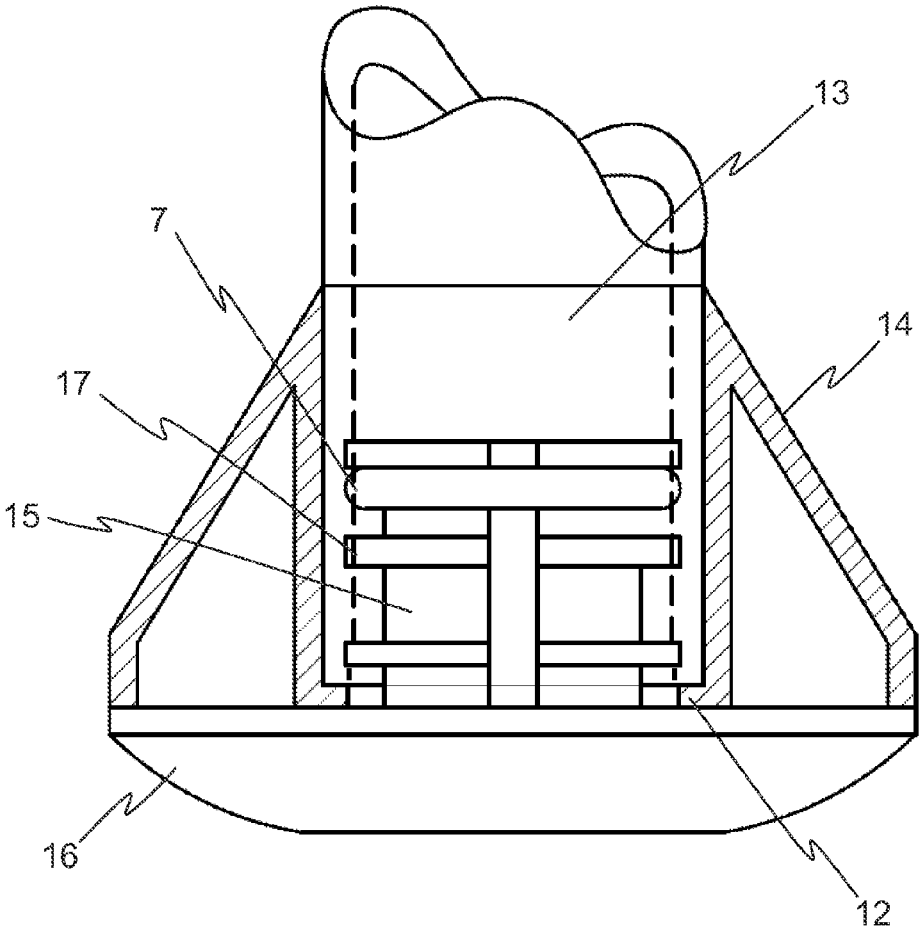
FIG. 1 is a cross-sectional side view of the completed assembly.

Referring to FIG. 1, there is disclosed a protective shield for medical walker legs. Said protective shield comprises a wear disk 16 for smooth walker moment on surfaces and a shield 14 to cover said wear disk to prevent users from stepping on said wear disk and to prevent dirt and debris from collecting on the unit. The wear disk 16 comprises an attached core 15 containing gripping flanges 17 and o-ring 7 to snugly fit into the medical walker tubing. The shield 14 further comprises a hollow center 13 and an inner ledge 12.

Referring now to the invention in more detail, in FIGS. 1, 2, 3, 4 and 5, there is shown an inner ledge 12 of the shield and a hollow center 13.

In more detail, still referring to FIGS. 1, 2, 3, 4, and 5 of the invention, the inner ledge 12 of the shield uses the downward force of the medical walker leg to hold the shield tightly against the wear disk.

Referring now to the invention in more detail, in FIGS. 1, 2, 3, 4, and 5, the shield 14 may be in a conical shape.

Figure 2:
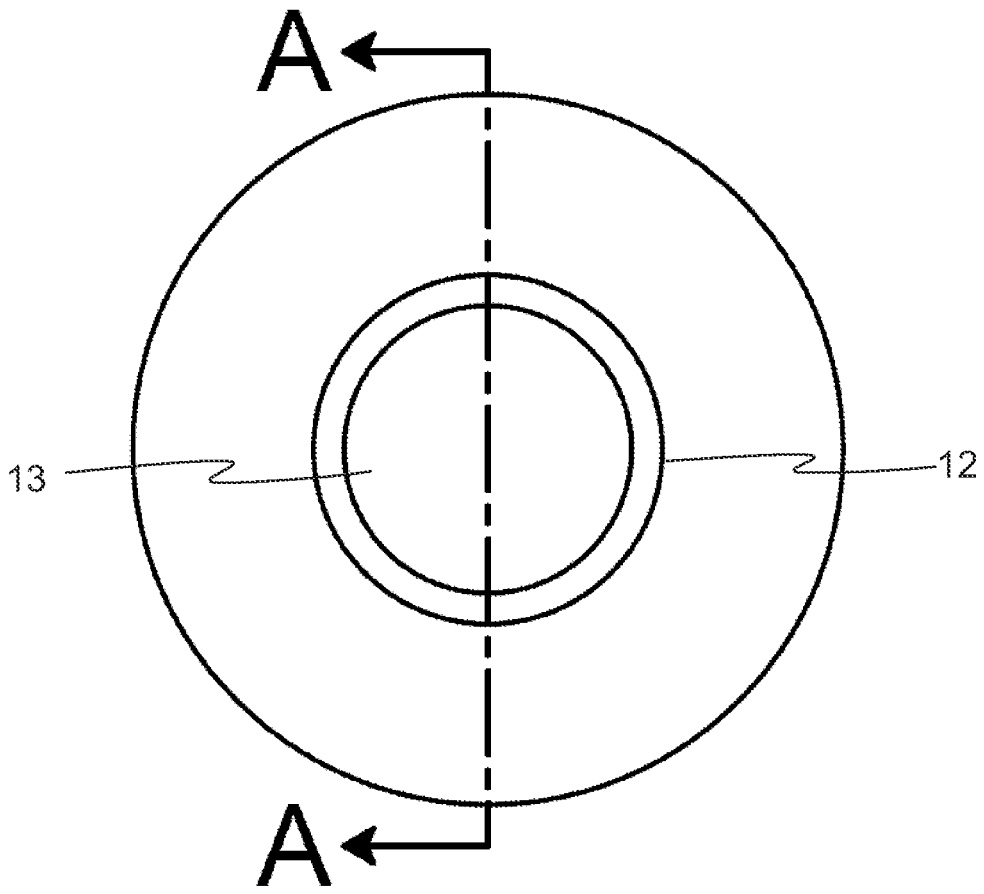
FIG. 2 is a top view of a shield of the present invention.
Figure 3:
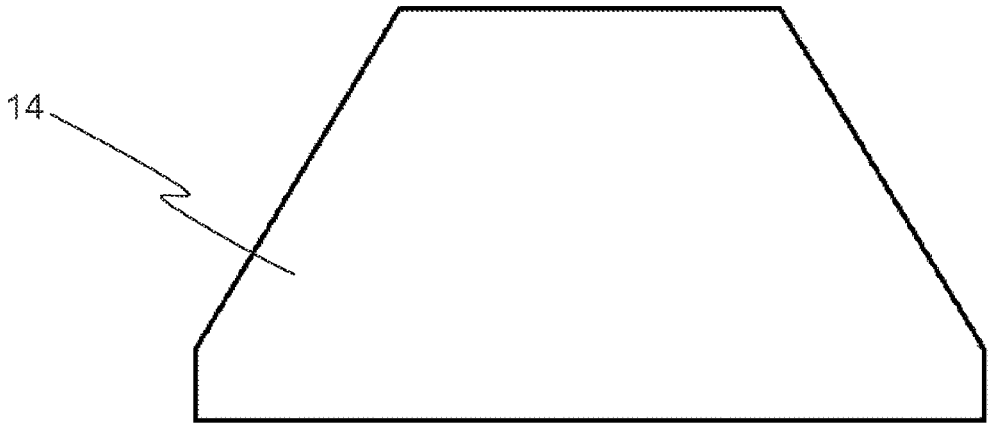
FIG. 3 is a side view of a shield of the present invention.
Figure 4:
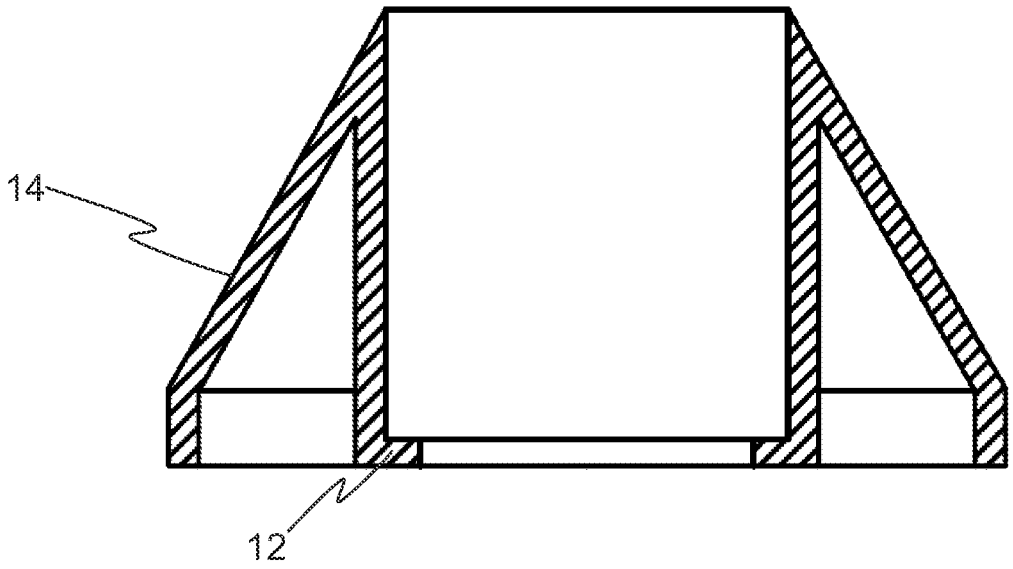
FIG. 4 is a cross-sectional view of the shield of the present invention.

In more detail, still referring to FIGS. 2, 3, and 4 of the invention, the shield 14 makes a visible surface to aid the user in orientation as well as prevents dirt and debris from collecting on the wear disk. The shield 14 acts as a protective shield to keep users from stepping on the flat surface of the wear disk and hindering movement and/or from catching on thresholds or other barriers when in use.

In more detail, still referring to FIGS. 1, 2, 3, 4 and 5 of the invention, the material is preferably made of a rigid weatherproof plastic or similar substance, having the ability to be colored for easy visibility. The material for the invention should also be strong enough to withstand the pressure placed upon it, especially the inner ledge of the shield 12.

Figure 6:
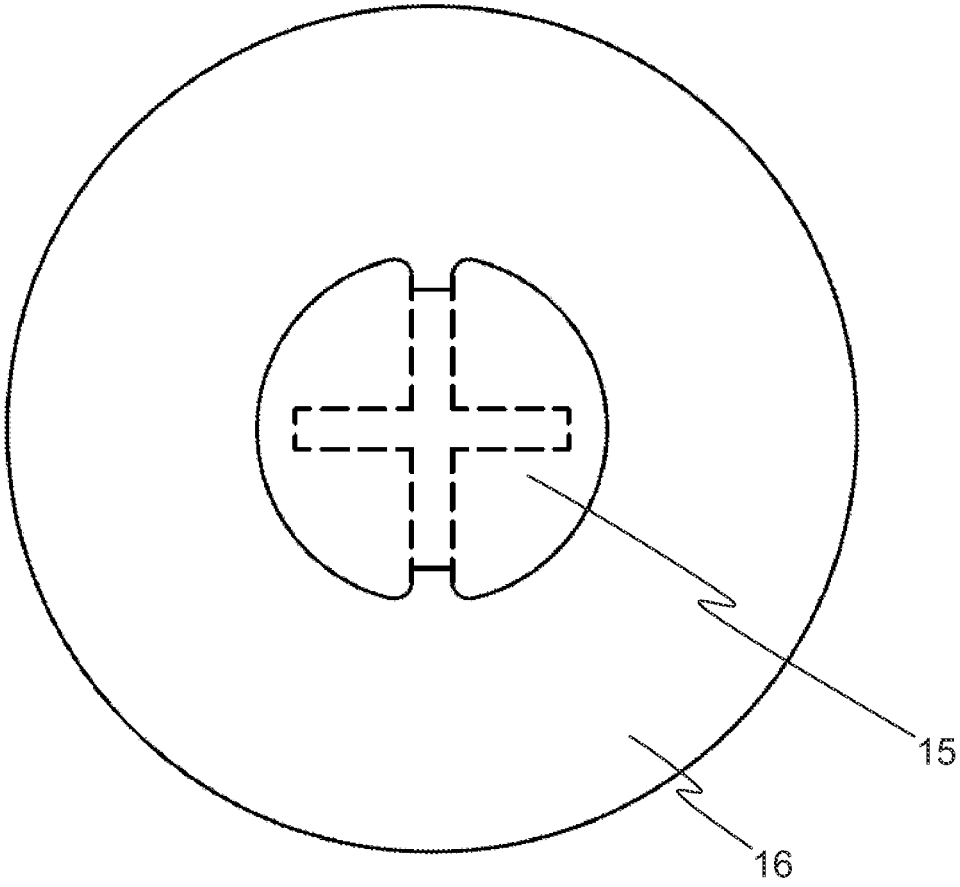
FIG. 6 is a top view of a wear disk without the O-ring of the present invention.
Figure 7:
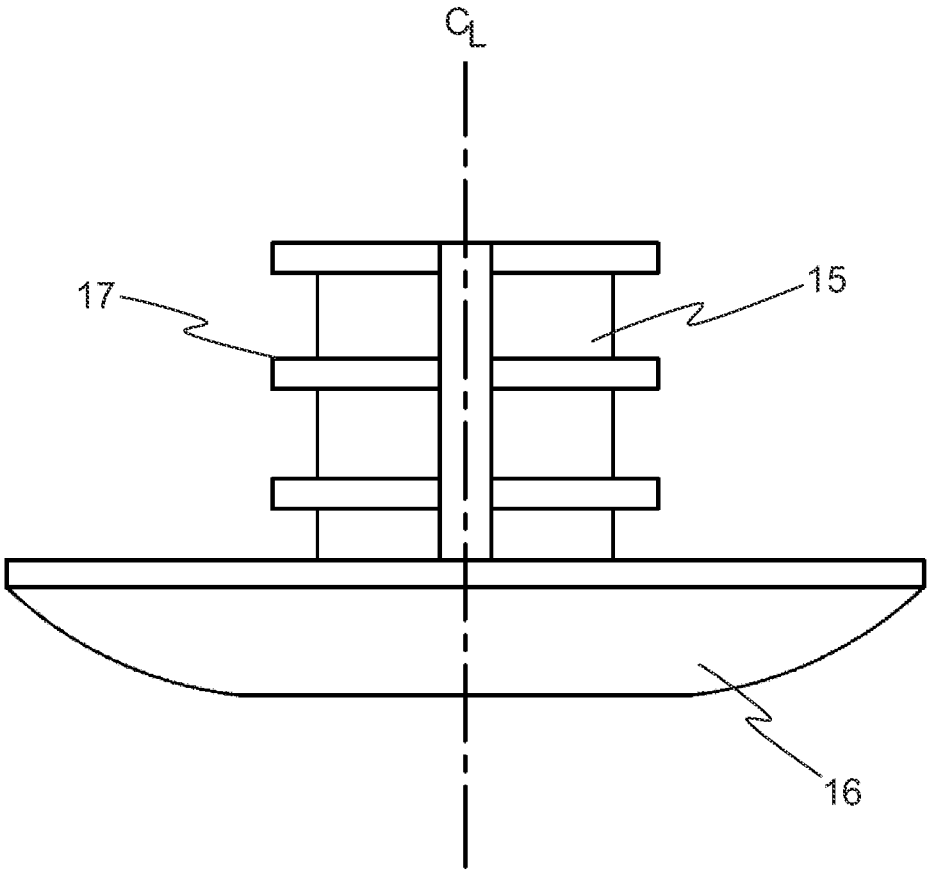
FIG. 7 is a side view of a wear disk and core without the O-ring of the present invention.

Referring now to the invention in more detail, in FIGS. 6 and 7 there is shown wear disk further comprises a core 15 with horizontal flanges 17.

In more detail, still referring to FIGS. 6 and 7 of the invention, the core 15, along with at least two attached horizontal flanges 17, is inserted into a medical walker leg. The horizontal flanges 17 act as stabilizers controlling the center line axis of the wear disk 16 in relation to the center line axis of the medical walker leg. The horizontal flanges 17 have a slight interference fit inside the tubing of a medical walker leg.

In more detail, still referring to FIGS. 6 and 7 of the invention, the wear disk 16 serves as a smooth surface that enables medical walkers to easily glide in all directions over a variety of surfaces. Having a rounded bottom enables the product to glide over uneven surfaces.

Figure 8:
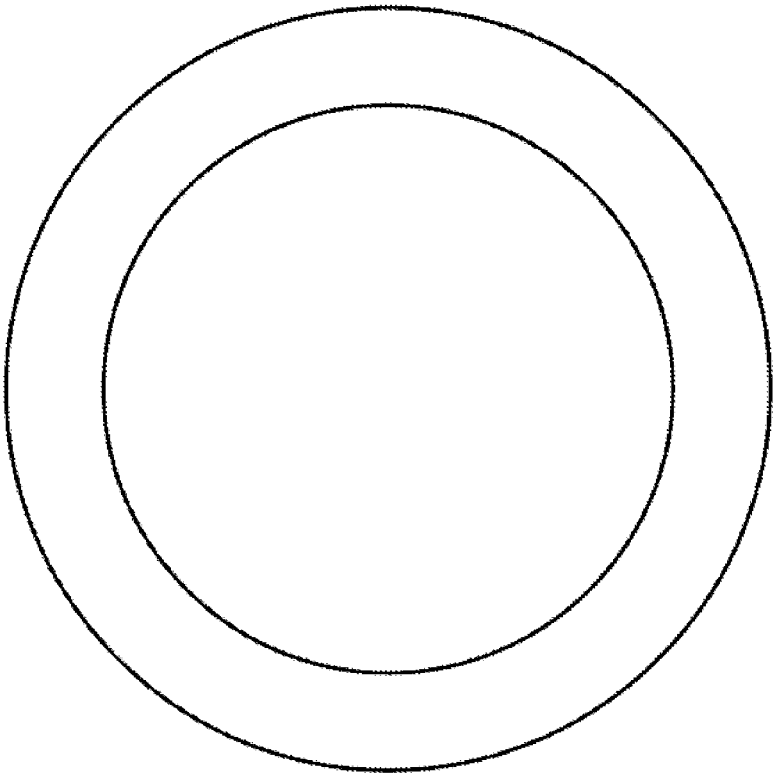
FIG. 8 is a top view of an O-ring of the present invention.
Figure 9:
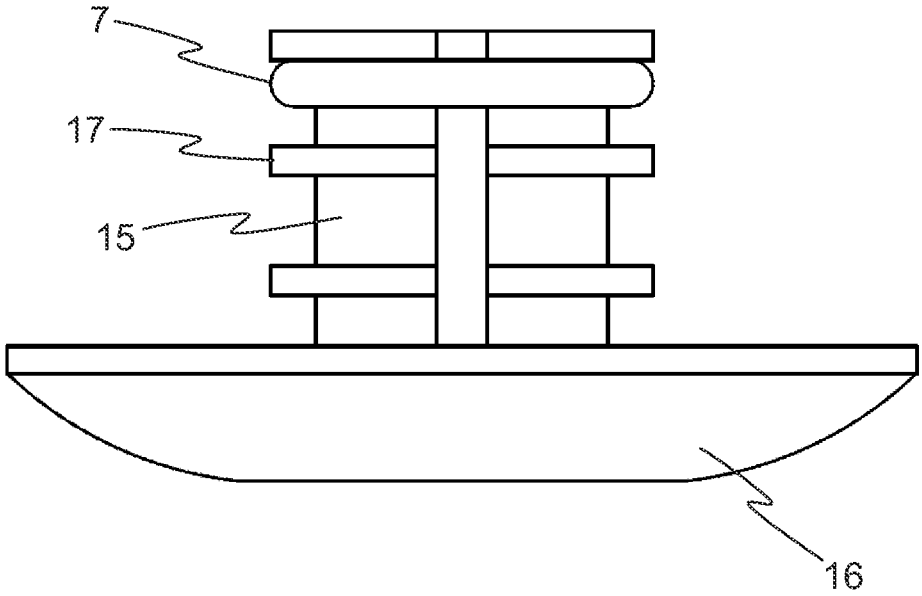
FIG. 9 is a side view of a wear disk and core with O-ring in place of the present invention.

Referring now to the invention in more detail, in FIGS. 8 and 9, there is shown an O-ring. The O-ring is attached to the core 15 and located between the top two horizontal flanges 17. This places the O-ring deep inside of the medical walker leg tubing for optimum gripping strength. This o-ring is compression resistant; over time, plastic materials in general will conform to their constraints especially under conditions where they are exposed to varying temperatures. The O-ring provides a means of assisting the core 15 to remain in place within the medical walker leg tubing over time.

Referring now to the invention in more detail, in FIG. 9, there is shown a side view of the core 15 with its horizontal flange 17 and the installed O-ring 7 located between the outer most fringe and the adjacent flange.

In more detail, still referring to FIG. 9, the core 15, horizontal flange 17 and installed O-ring 7 are connected to the wear disk 16 and then inserted into the hollow tubing of a medical walker leg to stabilize and secure the invention to the bottom of the leg.

Figure 10:
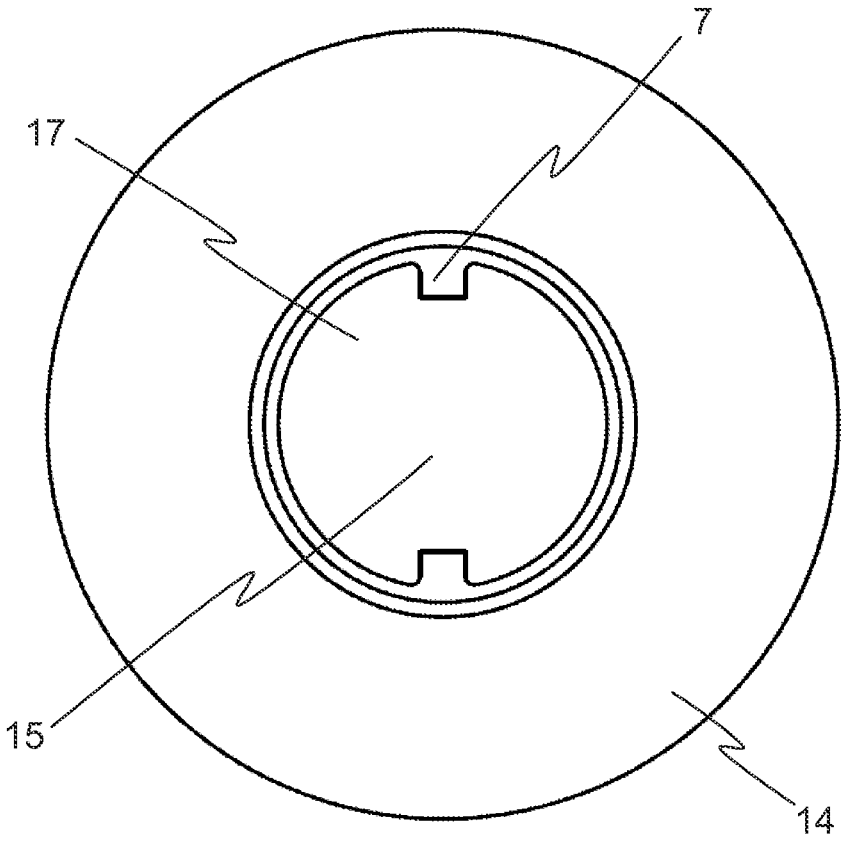
FIG. 10 is a top view of a completed assembly.

Referring now to the invention in more detail, in FIG. 10, there is shown a top view of the completed assembly with core 15, horizontal flange 17, o-ring 7 and shield 14.

Figure 11:
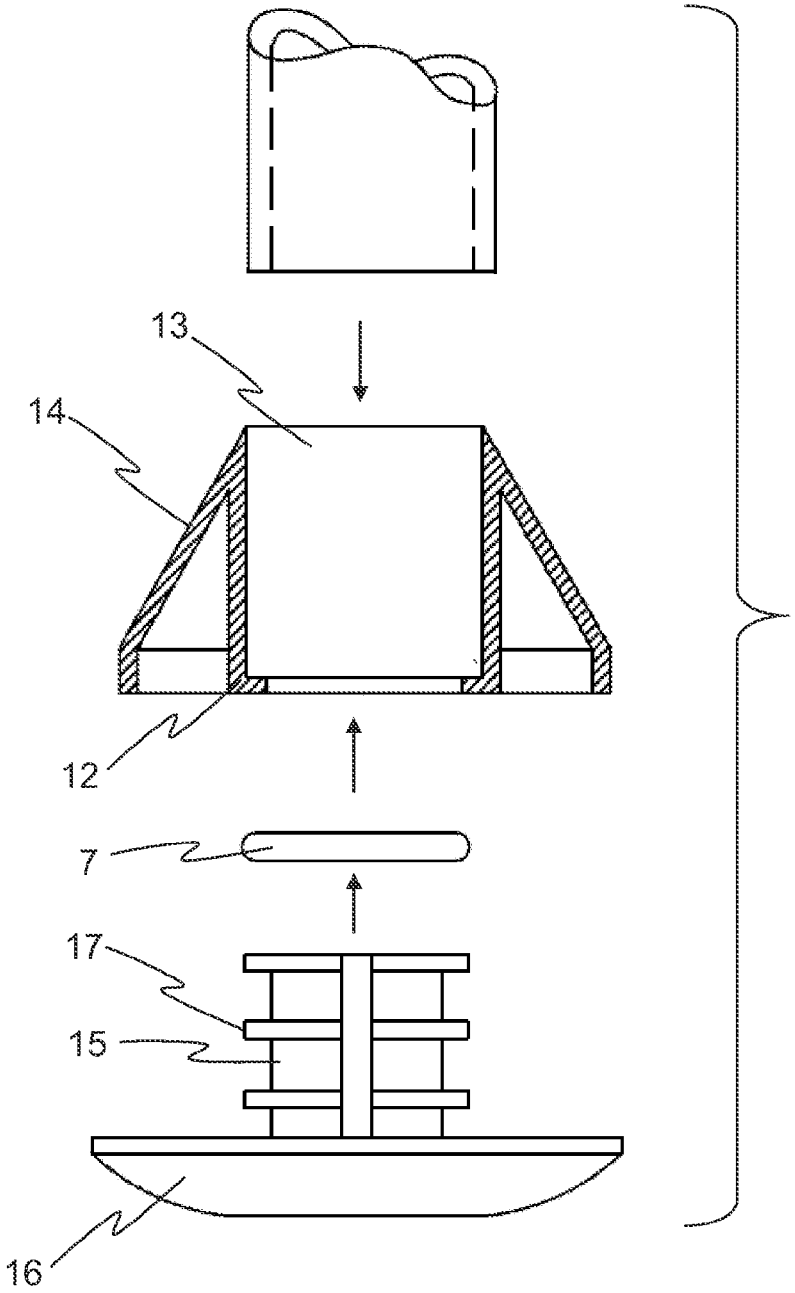
FIG. 11 is an exploded side view of the assembly.
Figure 12:
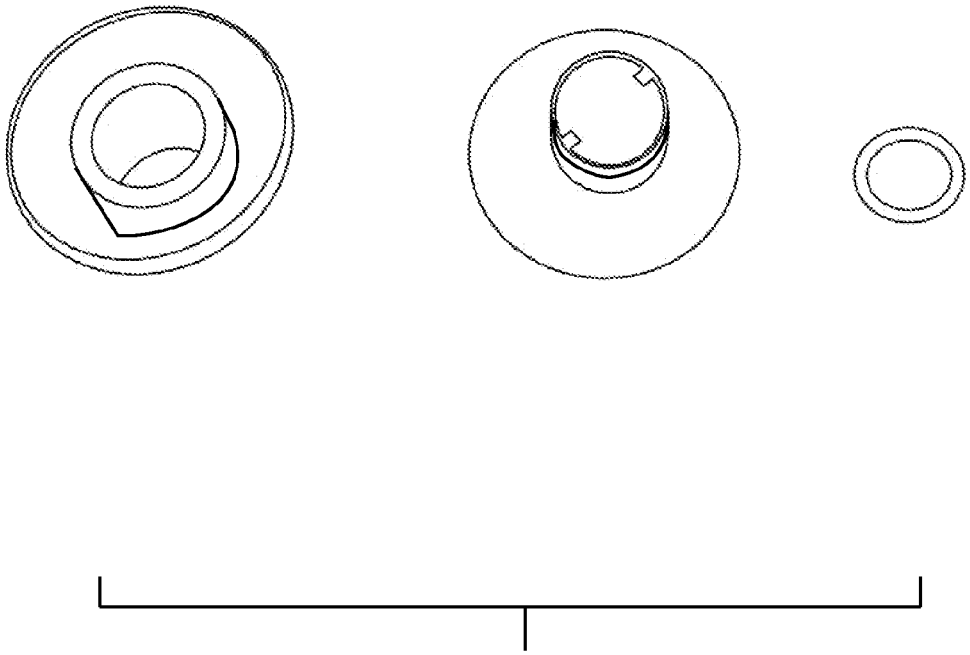
FIG. 12 is a photo of a particular embodiment of the present invention.

Referring now to the invention in more detail, in FIG. 11, there is shown an exploded side view of the completed assembly with hollow center 13, shield 14, inner ledge 12, O-ring 7, horizontal flange 17, core 15, and wear disk 16.

The construction details of the invention as shown in FIG. 1 to FIG. 4, are a shield which is made of a material that can be colored to enhance the visibility properties for orientation of the user to see where the leg of the walker is in relation to their feet to avoid tripping. The material preferably is made with a somewhat rigid property to resist denting or collapsing when bumped or stepped on and covers the top of the wear disk to prevent dirt and debris from collecting on it.

Figure 5:
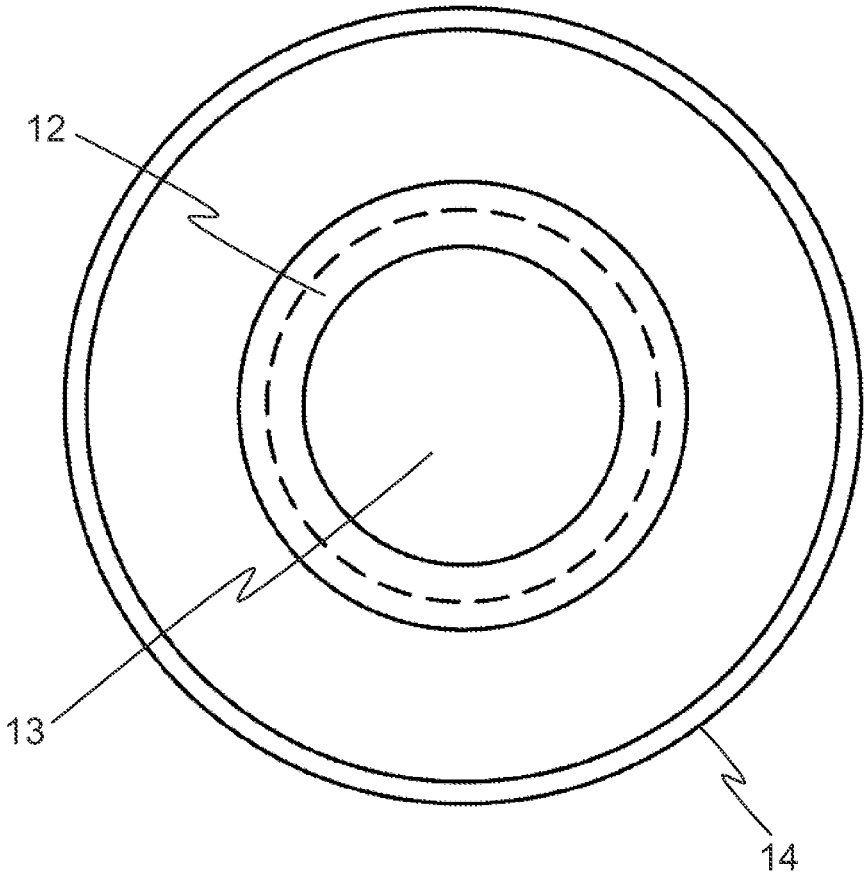
FIG. 5 is a bottom view of the shield of the present invention.

The construction details of the invention as shown in FIGS. 5 and 6, when considering material properties, that it capitalizes on a wear resistant material for use on rough surfaces such as cement and asphalt but at the same time is non-abrasive on interior flooring. The material has enough give to allow the horizontal flanges 17 to flex when inserted into the tubing of medical walker legs. The material also offers some resistance to prevent slipping on smooth surfaces.

The construction details of the invention as shown in FIG. 7, the O-ring is made of a rubber-like material with good elastic memory and resists deformation over time when exposed to a wide range of temperatures, which helps the core stay snug inside the walker leg. The O-ring material also has good gripping properties.

The advantages of the present invention include, without limitation, the unique shape of the device. The device easily attaches to the rear legs of medical walkers. Once installed, its shield shape allows users of medical walkers to easily maneuver over rough and uneven surfaces yet is not bulky enough to hinder users steps. The invention's shape also allows a walker to be pushed in any direction. The device was designed to fit all standard tubing medical walker legs with no tools required for assembly. The unique O-ring design helps the device stay snug to walker legs in all temperatures.

In broad embodiment, the present invention is a unique, plastic wear pad with a protective shield intended to easily and quickly attach to medical walker legs to enable users to move easily over a variety of surfaces without further hindrance or interruption to the user.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A walker comprising:

a tube defining a wear disk receiving cavity;

a protective glide including:

a rigid solid wear disk having a smooth rounded bottom surface adapted to glide over uneven surfaces, and a cylindrical core extending from a substantially planar top surface opposite said bottom surface, the core including at least two flanges extending about an outer periphery of the core, wherein the core is received in the wear disk receiving cavity such that the at least two flanges engage an inner wall of the tube in a frictional manner; and a shield including an inner wall defining a hollow center, and an outer sloping wall, wherein the hollow center fits about an outer wall of the tube, and the core of the wear disk extends through a lower opening of the shield into the wear disk receiving cavity of the tube.

2. The walker of claim 1, further comprising:

a compression resistant o-ring located about an outer wall of the core between the at least two flanges, the o-ring contacting and gripping the inner wall of the hollow tube to aid in retaining the core within the tube.

3. The walker of claim 1, wherein the outer sloping wall of the shield abuts the top surface of the wear disk to protect the top of the wear disk from accumulating dirt or debris.

4. A protective glide for a walker comprising:

a rigid solid wear disk having a smooth rounded bottom surface adapted to glide over uneven surfaces, and a cylindrical core extending from a substantially planar top surface opposite said bottom surface, the core including at least two flanges extending about an outer periphery of the core, wherein the core is configured to be received in a wear disk receiving cavity of a walker tube such that the at least two flanges engage an inner wall of the walker tube in a frictional manner; and a shield including an inner wall defining a hollow center, and an outer sloping wall, wherein the hollow center is configured to fit about an outer wall of a walker tube, and the core of the wear disk extends through a lower opening of the shield into the wear disk receiving cavity of the tube.

5. The protective glide of claim 4, further comprising:

a compression resistant o-ring located about an outer wall of the core between the at least two flanges, the o-ring being configured to contact and grip an inner wall of a hollow walker tube to aid in retaining the core within the tube.

6. The protective glide of claim 4, wherein the outer sloping wall of the shield abuts the top surface of the wear disk to protect the top of the wear disk from accumulating dirt or debris.

* * * * *